US009486825B2

(12) United States Patent
Ngo et al.

(10) Patent No.: US 9,486,825 B2
(45) Date of Patent: Nov. 8, 2016

(54) CONTROL SYSTEM FOR MOBILE FLUID DELIVERY MACHINE

(75) Inventors: Khanh T. Ngo, Peoria, IL (US); David C. Freeman, Chillicothe, IL (US); Peter W. Anderton, Peoria, IL (US); Balamurugesh Thirunavukarasu, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 1103 days.

(21) Appl. No.: 13/597,877

(22) Filed: Aug. 29, 2012

(65) Prior Publication Data

US 2014/0061329 A1 Mar. 6, 2014

(51) Int. Cl.

| | |
|---|---|
| ***B05B 17/04*** | (2006.01) |
| ***B05B 9/06*** | (2006.01) |
| ***E01H 3/02*** | (2006.01) |
| *B05B 1/20* | (2006.01) |

(52) U.S. Cl.
CPC . *B05B 9/06* (2013.01); *E01H 3/02* (2013.01); *B05B 1/20* (2013.01)

(58) Field of Classification Search
CPC ..... B05B 9/06; B05B 1/20; E01H 3/02
USPC ..... 239/11, 146, 172, 174, 74
See application file for complete search history.

(56) References Cited

U.S. PATENT DOCUMENTS

| | | | | |
|---|---|---|---|---|
| 5,028,017 | A * | 7/1991 | Simmons | B64F 5/0063 239/131 |
| 6,551,073 | B1 | 4/2003 | O'Sullivan | |
| 6,808,121 | B2 | 10/2004 | Rice | |
| 7,896,258 | B2 | 3/2011 | Hoisington et al. | |
| 8,162,619 | B2 | 4/2012 | Laskaris | |
| 2006/0191254 | A1* | 8/2006 | Bui | F01N 3/101 60/286 |
| 2010/0301134 | A1* | 12/2010 | Anderton | E01H 10/007 239/172 |
| 2011/0160920 | A1* | 6/2011 | Orr | A01B 79/005 700/283 |
| 2013/0320105 | A1* | 12/2013 | Schmidt | A01M 7/0089 239/1 |

FOREIGN PATENT DOCUMENTS

| | | |
|---|---|---|
| WO | WO 2011/090522 | 7/2011 |

* cited by examiner

*Primary Examiner* — Arthur O Hall
*Assistant Examiner* — Joel Zhou
(74) *Attorney, Agent, or Firm* — Finnegan, Henderson, Farabow, Garrett & Dunner, LLP

(57) ABSTRACT

A control system is disclosed having at least one spray head, a fluid pump, and a power converter driving the fluid pump. The control system may also have an interface device to receive at least one parameter associated with a desired fluid delivery event, a pressure sensor configured to generate a first signal, a travel speed sensor configured to generate a second signal, and a controller. The controller may be configured to determine a desired fluid pressure based on the at least one parameter, and determine a control command for the power converter based on the desired fluid pressure. The controller may be further configured to determine a feed-forward gain parameter based on the at least one parameter and the second signal, determine a feedback gain parameter based on a difference between desired and actual fluid pressures, and adjust the control command based on the feedforward and feedback gain parameters.

6 Claims, 3 Drawing Sheets

CONTROL SYSTEM FOR MOBILE FLUID DELIVERY MACHINE

TECHNICAL FIELD

This disclosure relates generally to a control system and, more particularly, to a control system for a mobile fluid delivery machine.

BACKGROUND

Work environments associated with certain industries, such as the mining and construction industries, are susceptible to undesirable dust conditions. Mining, excavation, and construction sites, in particular, are susceptible to dust due to the nature of the materials composing the worksite surface. For example, ground surfaces of coal, shale, stone, etc., erode easily, and thus tend to produce significant amounts of dust. Moreover, typical work operations performed at these sites exacerbate the dust conditions. At a mine site, for example, cutting, digging, and scraping operations break up the ground surface, generating dust. In addition, heavy machinery, such as haul trucks, dozers, loaders, excavators, etc., traveling on such sites disturb settled dust, thereby increasing the dust level of the air.

Dusty conditions can reduce the efficiency of a worksite. For example, dust can impair visibility, interfere with work operations on the site, and require increased equipment maintenance and cleaning. In addition, dust conditions may affect the comfort of worksite personnel. To alleviate these conditions, a water truck is often used to control the amount of dust in the air at the worksite. Specifically, the water truck periodically drives around the worksite and sprays the ground surface with water, which saturates the dust and causes the dust to remain at ground level.

Historically, little control has been exercised over the spraying of water at a worksite. That is, most water trucks available on the market today are fabricated by the end user from different subcomponents normally used for other purposes. For example, a truck body from a first manufacturer may be fitted with a water tank from a second manufacturer and with sprayers from a third manufacturer. Basic controls would then be connected to the different components and used to simply turn on the sprayers and turn them off again when manually manipulated by an operator of the machine. Little attention was paid to the pressure of the water, the volume of the water, the spray path of the water, the flow pattern of the water, etc. Although acceptable in some applications, this approach has been less than optimal.

U.S. Patent Publication No. 2010/0301134 of Anderton et al. that published on Dec. 2, 2010 (the '134 publication) discloses an exemplary mobile fluid distribution system with improved control. The mobile fluid distribution system of the '134 publication includes a power source, a hydraulic pump driven by the power source, a hydraulic motor driven by the hydraulic pump, a water pump driven by the hydraulic motor, and a plurality of spray heads in fluid communication with the water pump. The system also includes a ground speed sensor, a water pressure sensor, an engine speed sensor, a water shaft sensor, and a controller in communication with each of the sensors. The controller is configured to determine a desired water pressure based on a signal from the ground speed sensor and a mode selection from an operator, and responsively control the displacement of the hydraulic motor to achieve the desired water pressure in the selected mode. The displacement of the hydraulic motor is controlled based on the desired water pressure, a signal from the water pressure sensor, a signal from the water pump shaft speed sensor, and a signal from the engine speed sensor.

Although an improvement over existing control systems, the system of the '134 publication may still be less than optimal. In particular, the system of the '134 publication may not consider a sufficient number and type of factors affecting water pressure control under different conditions. In addition, the system of the '134 publication may not be capable of adjusting the way in which the displacement of the hydraulic motor is controlled. Without this input and capability, the system of the '134 patent may not accurately track desired pressure under all conditions.

The disclosed control system is directed to overcoming one or more of the problems set forth above and/or other problems of the prior art.

SUMMARY

In one aspect, the present disclosure is directed to a control system for use with a mobile fluid delivery machine. The control system may include at least one spray head, a fluid pump configured to pressurize a fluid directed to the at least one spray head, and a power converter operatively driven by the mobile fluid delivery machine to deliver an adjustable power output to the fluid pump. The control system may also include an interface device configured to receive from an operator of the mobile fluid delivery machine at least one parameter associated with a desired fluid delivery event, a pressure sensor associated with the fluid pump and configured to generate a first signal indicative of an actual pressure of fluid discharged from the fluid pump, a travel speed sensor configured to generate a second signal indicative of a travel speed of the mobile fluid delivery machine; and a controller in communication with the power converter, the interface device, the pressure sensor, and the travel speed sensor. The controller may be configured to determine a desired fluid pressure based on the at least one parameter, and to determine a control command for the power converter based on the desired fluid pressure. The controller may be further configured to determine a feedforward gain parameter based on the at least one parameter and the second signal, to determine a feedback gain parameter based on a difference between the desired and actual fluid pressures, and to adjust the control command based on the feedforward and feedback gain parameters.

In another aspect, the present disclosure is directed to a method of controlling a mobile fluid delivery machine. The method may include directing an adjustable power output from the mobile fluid delivery machine through a power converter to a fluid pump, and directing pressurized fluid from the fluid pump to at least one spray head. The method may further include receiving from an operator of the mobile fluid delivery machine at least one parameter associated with a desired fluid delivery event, and detecting an actual pressure of fluid discharged from the fluid pump. The method may additionally include determining a desired fluid pressure based on the at least one parameter, and determining a control command for the power converter based on the desired fluid pressure. The method may also include determining an engine speed of the mobile fluid delivery machine, determining a speed of the fluid pump, determining a feedforward gain parameter based on the engine speed and the speed of fluid pump, determining a feedback gain parameter based on a difference between the desired and actual fluid pressures, and adjusting the control command based on the feedforward and feedback gain parameters.

DETAILED DESCRIPTION

Figure 1:
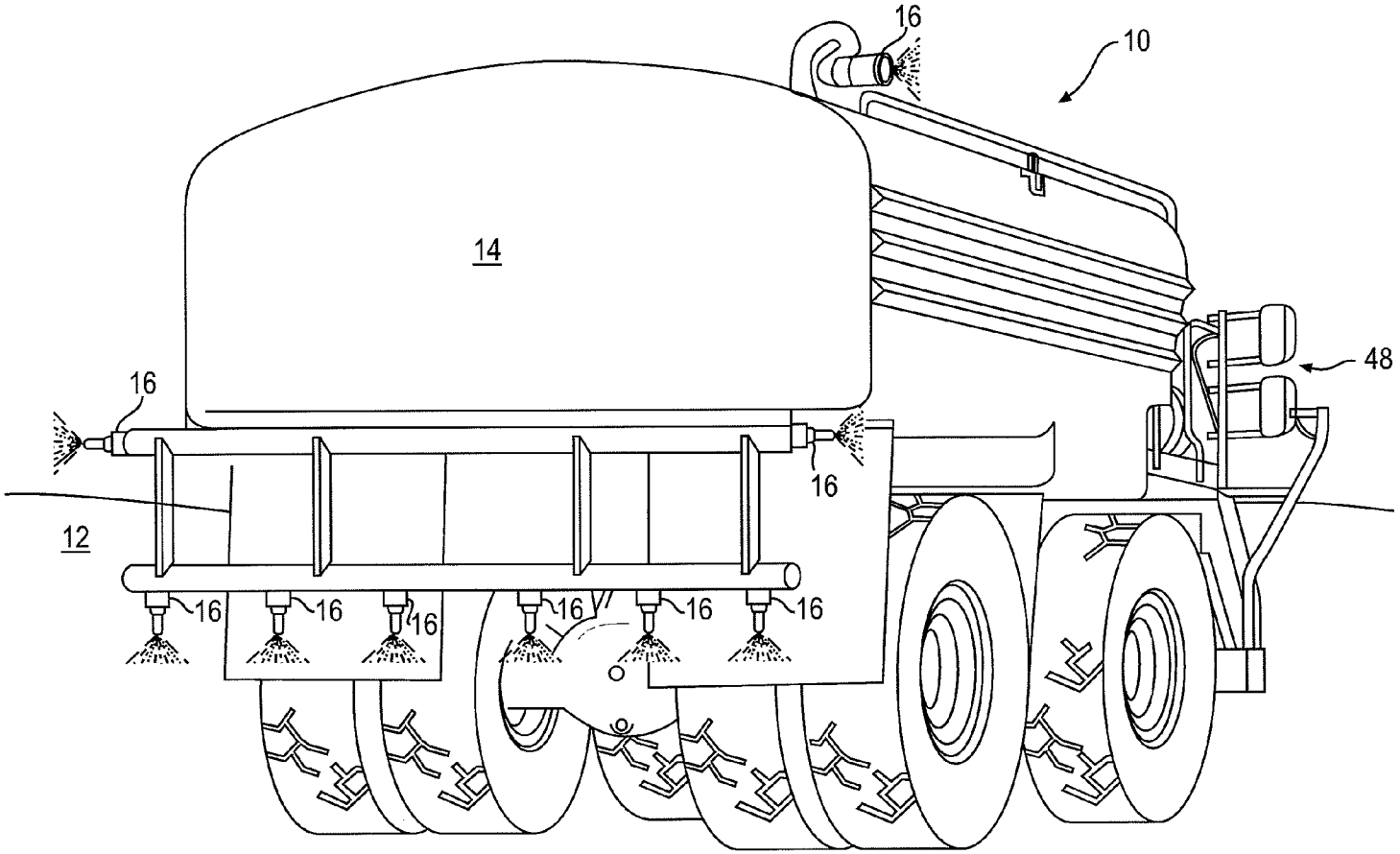
FIG. 1 is a pictorial illustration of an exemplary disclosed mobile fluid delivery machine.

FIG. 1 illustrates an exemplary mobile machine 10 operating at a worksite 12. Worksite 12 may be a surface mine site, where mining operations generate dust levels that create undesirable conditions for worksite personnel. For example, the dust may impair visibility, reduce air quality, require frequent equipment maintenance or cleaning, or otherwise hinder operations at worksite 12. The disclosed mobile machine 12 is not limited to use at a mine site, however, and worksite 12 could alternatively be a construction site, a landfill, or any site at which undesirable dust conditions may arise.

Mobile machine 10 may be an operator-controlled machine, an autonomous (i.e., unmanned) machine, or a semi-autonomous machine and embody a fluid delivery machine (generally referred to as a "water delivery truck" or "water truck"). Accordingly, mobile machine 10 may be configured to travel worksite 12 along a network of haul roads and to deliver fluid (e.g., water) onto the ground surface of worksite 12 to control dust levels on the haul roads.

FIG. 1 illustrates one exemplary embodiment of mobile machine 10 outfitted with, among other things, a fluid tank 14 configured to store fluid (e.g., water), and one or more spray heads 16 that are configured to spray the fluid stored in tank 14 onto the ground surface of worksite 12 as mobile machine 10 traverses worksite 12. Although shown as a self-propelled vehicle, it is contemplated that mobile machine 10 could alternatively embody a towed vehicle such as a trailer (or combination of tractor/trailer), if desired. It is further contemplated that fluids other than water may be stored in tank 14 and distributed by spray heads 16. For example, tank 14 could hold a supply of chemicals (e.g., pesticide, fertilizer, herbicide, etc.) for use in an agricultural setting; a saline solution for use on ice-covered roadways; or another fluid useful in these or other environments.

Figure 2:
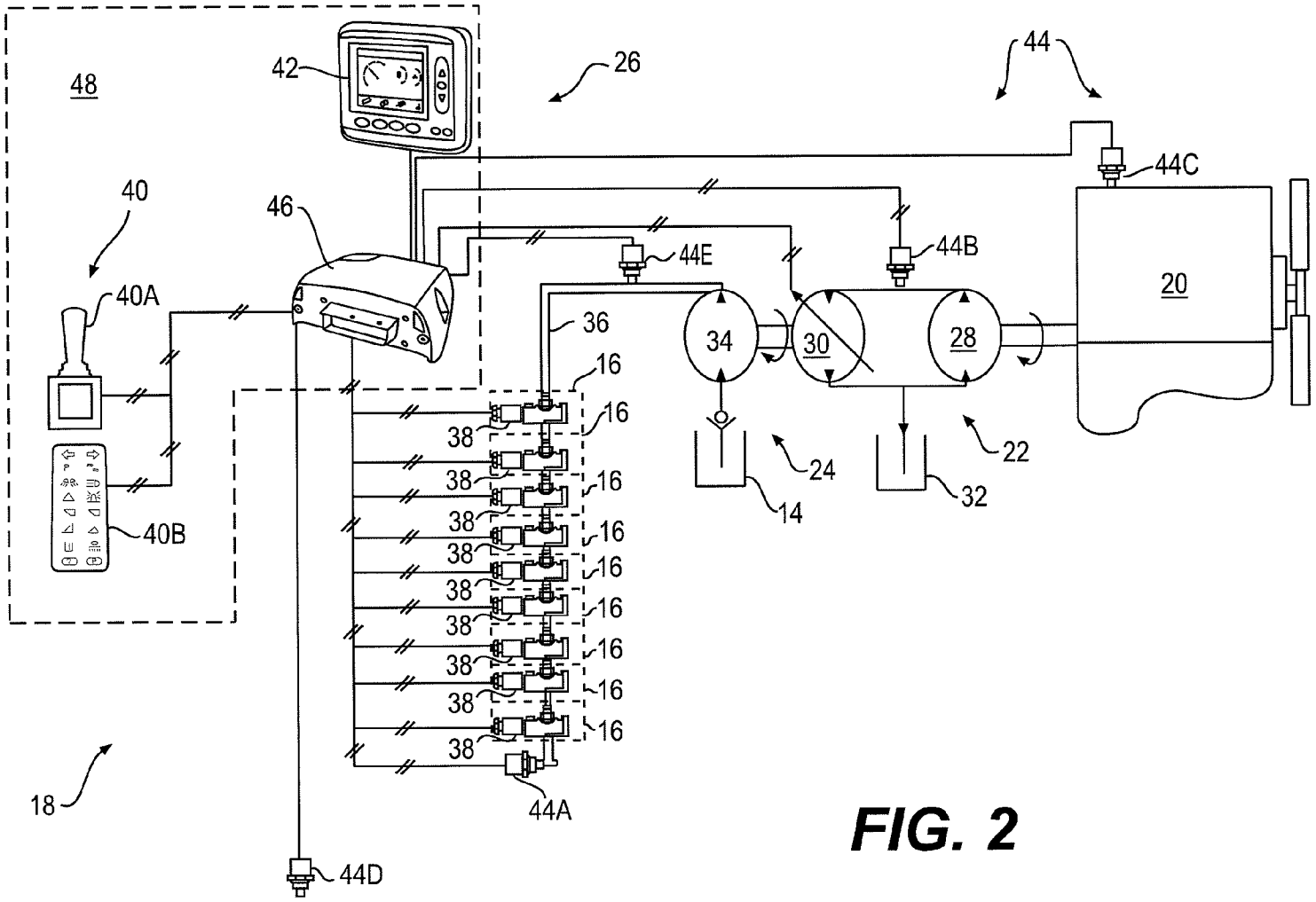
FIG. 2 is a diagrammatic illustration of an exemplary disclosed control system that may be used in conjunction with the mobile fluid delivery machine of FIG. 1.

Mobile machine 10 shown in FIG. 2 includes a plurality of different spray heads 16 arranged in a particular configuration. Specifically, six different spray heads 16 are shown arranged to spray water downward toward the surface of worksite 12 in spaced apart positions; two different spray heads 16 are shown arranged to spray water to the left and right of machine 10; and a single spray head 16 is shown arranged to spray water from on top of machine 10 in any direction selected by an operator and/or controller of machine 10. It is contemplated, however, that any number and type of spray heads 16 may be mounted to mobile machine 10, at any location, and with any orientation. It is further contemplated that some or all of the spray heads 16 may operate together or independently, depending on a particular mode of operation that has been selected by the operator and/or controller of machine 10.

FIG. 2 illustrates an exemplary fluid delivery system 18 configured to regulate and facilitate operation of spray heads 16, in a manner consistent with this disclosure. As shown in the figure, fluid delivery system 18 may include, among other things, a power source 20 configured to supply power to machine 10, a power converter 22 that converts a mechanical output of power source 20 into hydraulic power usable by spray heads 16, a fluid circuit 24 configured to supply spray heads with pressurized fluid, and a control system 26 configured to control operations of power source 20, power converter 22, and fluid circuit 24.

The power from power source 20 may be used for many different purposes. For example, the mechanical output of power source 20 may be used to pressurize and move the fluid subsequently distributed by spray heads 16, to propel machine 10, to generate electricity that drives electronic components of fluid delivery system 18 and other auxiliary loads, etc. Power source 20 may embody, for example, an internal combustion engine, an electric motor, a combustion engine-electric hybrid system, or another type of power source known in the art.

Power converter 22 may include a hydraulic pump 28 and a hydraulic motor 30 that is fluidly coupled with and driven by hydraulic pump 28. In one embodiment, hydraulic pump 28 may be a fixed-displacement pump, while hydraulic motor 30 may be a variable-displacement motor. In the disclosed embodiment, hydraulic pump 28 is an existing pump already in use on machine 10 for other purposes. For example hydraulic pump 28 may be associated with a transmission (not shown) and used to pressurize fluid that engages and disengages clutches of the transmission. Alternatively, hydraulic pump 28 may be associated with a braking system, a steering system, a tool system, or another system known in the art. By using an existing hydraulic pump that is already in the consist of machine 10, the component count and cost of machine 10 may be reduced. It is contemplated that hydraulic pump 28 could alternatively be dedicated to fluid delivery system 18, if desired.

By pairing a variable-displacement hydraulic motor 30 with the existing fixed-displacement hydraulic pump 28, the operation of fluid delivery system 18 can be controlled independent of any other systems associated with hydraulic pump 28. For example, hydraulic pump 28 may rotate at a speed and/or with a force demanded by the other systems connected to hydraulic pump 28, and the displacement of hydraulic motor 30 may be adjusted to still accommodate the demands of fluid delivery system 18. In this manner, the other systems driven by hydraulic pump 28 may be substantially unaffected by load changes from fluid delivery system 18. In alternative embodiments, hydraulic pump 28 and hydraulic motor 30 may be other suitable combinations of fixed- and/or variable-displacement devices.

Continuing with FIG. 2, an input of hydraulic pump 28 may be mechanically or otherwise coupled to power source 20 to receive the mechanical output thereof. An output of hydraulic pump 28, in turn, may be hydraulically coupled to an input of hydraulic motor 30 via well-known hydraulic components (e.g., via open- or closed-loop circuitry). The mechanical power output may drive hydraulic pump 28 to draw hydraulic fluid (e.g., oil) from hydraulic motor 30 (and/or a supply tank 32), pressurize the hydraulic fluid, and direct the hydraulic fluid back through hydraulic motor 30 to drive hydraulic motor 30. The hydraulic fluid, after passing through hydraulic motor 30, may return to hydraulic pump 28 (and/or to supply tank 32). During operation of hydraulic motor 30, a displacement control mechanism, for example a swashplate or a spill valve, may be adjusted so as to vary a speed and/or torque of hydraulic motor 30 for a given flow and/or pressure of fluid from hydraulic pump 28.

An output of hydraulic motor 30 may be used as an input to fluid circuit 24. In particular, a mechanical output of hydraulic motor 30 may be coupled to drive a fluid pump 34 of fluid circuit 24. Fluid pump 34 may be a fixed-displacement pump or a variable-displacement pump that is fluidly connected to draw fluid from tank 14, pressurize the fluid, and distribute the pressurized fluid at an elevated pressure to spray heads 16 via one or more manifolds 36. It should be noted that, although all spray heads 16 are shown in FIG. 2 as being fluidly coupled in parallel with a single manifold 36, it is contemplated that spray heads 16 may be arranged into multiple different groups that receive fluid via separate manifolds 36, if desired.

Spray heads 16 may themselves be independently controllable. For example, each spray head 16 may include a valve mechanism 38, for example a variable orifice that is solenoid-driven, which can be continuously-adjusted between a fully-closed position and a fully-open position. Alternatively, valve mechanisms 38 may be capable of only being fully-closed or fully-opened. In addition, spray heads 16 may be controllable to vary a width, a distribution angle, and/or a direction of the emitted fluid, if desired. For example, spray heads 16 may be controlled to provide a narrow spray, a medium-width spray, a wide spray, or a spray continuously-variable between the narrow spray and the wide spray. In this manner, haul roads of varying widths may be adequately coated with fluid.

Control system 26 may include components that together are configured to control operations of power source 20, power converter 22, and fluid circuit 24 to thereby generate a desired fluid spray event selected by an operator of machine 10. In particular, control system 26 may include one or more interface devices 40, a display 42, one or more sensors 44, and a controller 46 in communication with power source 20, power converter 22, interface devices 40, display 42, and sensors 44. Based on various input from interface devices 40 and sensors 44, as will be described in more detail below, controller 46 may be configured to regulate operations of power converter 22 and/or spray heads 16 to produce the desired spray events selected by the operator of machine 10. Controller 46 may also be configured to cause parameters associated with the spray events to be shown on display 42 for use by the operator.

Interface devices 40 may be co-located within an operator station 48 of mobile machine 10, and be manipulated by an operator to generate command signals indicative of desired functions (e.g., desired fluid spray events). In the disclosed embodiment, interface devices 40 include a direction interface 40A and a mode interface 40B. It should be noted, however, that additional interface devices 40 may be included, if desired. Each interface device 40 may take the form of a joystick, a pedal, a push-button, a knob, a switch, or another known device.

Direction interface 40A, in the disclosed exemplary embodiment, is shown as a joystick that is manually tiltable and/or rotatable through one or more ranges from a neutral position to a maximum displaced position to generate one or more corresponding displacement signals that are indicative of a desired spray direction of one or more of spray heads 16. For example, spray direction device 40A may be tiltable from the neutral position to a maximum displaced position in a first direction to generate a corresponding first displacement signal indicative of a desired change in a vertical angle of the spray head 16 located on top of tank 14 (referring to FIG. 1). Likewise direction interface 40A may be rotatable and/or tiltable from the neutral position to a maximum displaced position in a second direction to generate a second displacement signal indicative of a desired change in a horizontal angle of the spray head 16. The first and second displacement signals generated by direction interface 40A may be directed to controller 46 for further processing.

Mode interface 40B, in the disclosed embodiment, may be used by an operator to select different modes of operation and/or specific functionality associated with each selectable mode. Specifically, mode interface 40B may be a touch pad having a plurality of push buttons that, when pressed by the operator of machine 10, select any number of available control settings. For example, the operator may press a first of the buttons to select one of multiple predefined modes of operation. The multiple predefined modes of operation may include, among others, modes associated with particular groupings of spray heads 16 (e.g., a first mode associated with use of only the six downward pointing spray heads 16, a second mode associated with only the two outward facing spray heads 16, a third mode associated with only the top-mounted spray head 16, a fourth mode associated with all of the spray heads 16, etc.), and an ala carte mode (a mode in which the operator selects individual spray heads 16 for use in a particular spray event). Similarly, the operator may press the same or a second button to select a desired pattern of spraying (e.g., continuous, intermittent, etc.), a desired spray direction or width, a desired spray pressure, a desired flow rate of sprayed fluid, a desired pulse frequency, and/or a desired coverage of the ground surface at worksite 12. It is contemplated that additional and/or different modes and/or functionality may be selectable by the operator via mode interface 40B, if desired. Signals generated by mode interface 40B may be directed to controller 46 for further processing.

Display 42 may also be housed within operator station 48, and used to display parameters indicating certain aspects of machine status and/or performance for operator acknowledgment. Display 42 may be one of a liquid crystal display, a cathode ray tube display, a plasma display, or any other type of display known in the art. Display 42 may be caused by controller 46 to display fluid delivery settings affected by interface devices 40, for example a current mode setting, a current spray pattern or width, a current spray pressure, a current spray flow rate, and other parameters known in the art. It is to be appreciated that display 42 may itself also receive operator input by way of a touch-screen, software keys, and the like.

Each of sensors 44 may be configured to detect and/or measure at least one operational aspect associated with fluid delivery system 18. As shown in FIG. 2, the sensors mounted to machine 10 may include, among others, a fluid pressure sensor 44A, a hydraulic pressure sensor 44B, an engine sensor 44C, a travel speed sensor 44D, and a shaft speed sensor 44E. Additional sensors not shown or discussed in this disclosure could include a travel state sensor that detects a forward, reverse, or parked state of machine 10, a fluid level sensor associated with tank 14, and a hydraulic oil temperature and/or level sensor associated with power converter 22. Each of these sensors may generate signals directed to controller 46 for further processing.

Fluid pressure sensor 44A may be associated with fluid circuit 24 and configured to generate a signal indicative of the pressure of fluid therein. For example, fluid pressure sensor 44A could be located to generate a signal indicative of a pressure of fluid discharged from fluid pump 34, a pressure of fluid at a particular one or more of spray heads 16, a pressure of manifold 36, or another associated pressure. A value of the signal generated by fluid pressure sensor 44A may be generally proportional to a value of the measured pressure.

Hydraulic pressure sensor 44B may be associated with power converter 22 and configured to generate a signal indicative of the pressure of hydraulic fluid therein. For example, fluid pressure sensor 44B could be located to generate a signal indicative of a pressure of fluid discharged from hydraulic pump 28, a pressure of fluid received by hydraulic motor 30, a pressure of fluid discharged by hydraulic motor 30, a differential pressure across hydraulic motor 30, or another associated pressure. A value of the signal generated by hydraulic pressure sensor 44B may be generally proportional to a value of the measured pressure.

Engine sensor 44C may be configured to sense one or more operational parameters of power source 20. In the disclosed embodiment, the operational parameter includes a rotational output speed of power source 20. It should be noted, however, that other parameters, for example a fueling parameter, a transmission gear ratio parameter, a temperature parameter, or another suitable parameter of power source 20 could alternatively be detected and/or monitored by engine sensor 44C. As a rotational output speed sensor, the rotation of a component (such as an output shaft) of power source 20 may be measured and a signal generally proportional to the speed thereof may be generated.

Travel speed sensor 44D may be configured to sense the ground speed of mobile machine 10 during travel at worksite 12. For example, travel speed sensor 44D may sense a rotation of a transmission or final drive gear or shaft, such as by detecting rotation of a magnetic gear tooth with a Hall Effect element. Alternatively, travel speed sensor 44D could be associated with a GPS, local laser, IMU, or other position tracing system and configured to generate a ground speed signal based on a change in position of machine 10 over a predetermined period of time. Travel speed sensor 44D, regardless of its configuration, may generate a signal generally proportional to the speed of machine 10 across the ground surface of worksite 12.

Shaft speed sensor 44E may be a rotational speed sensor configured to sense a rotational output of fluid pump 34. Shaft speed sensor 44E may generate a signal generally proportional to the speed of fluid pump 34.

Controller 46 may embody, for example, one or more general microprocessors capable of controlling numerous functions of fluid delivery system 18. Controller 46 may include a memory, a secondary storage device, a processor (e.g., a CPU), or any other components for executing programs to perform the disclosed functions of fluid delivery system 18. Various other circuits may be associated with controller 46, such as power supply circuitry, signal conditioning circuitry, data acquisition circuitry, signal output circuitry, signal amplification circuitry, and other types of circuitry known in the art. It is to be understood that controller 46 may include various types of processors, such one or more ECMs (Electronic Control Modules) of machine 10. Alternately, controller 46 may be in communication with such ECM(s), or such ECM(s) may be entirely omitted from fluid delivery system 18, as desired.

Figure 3:
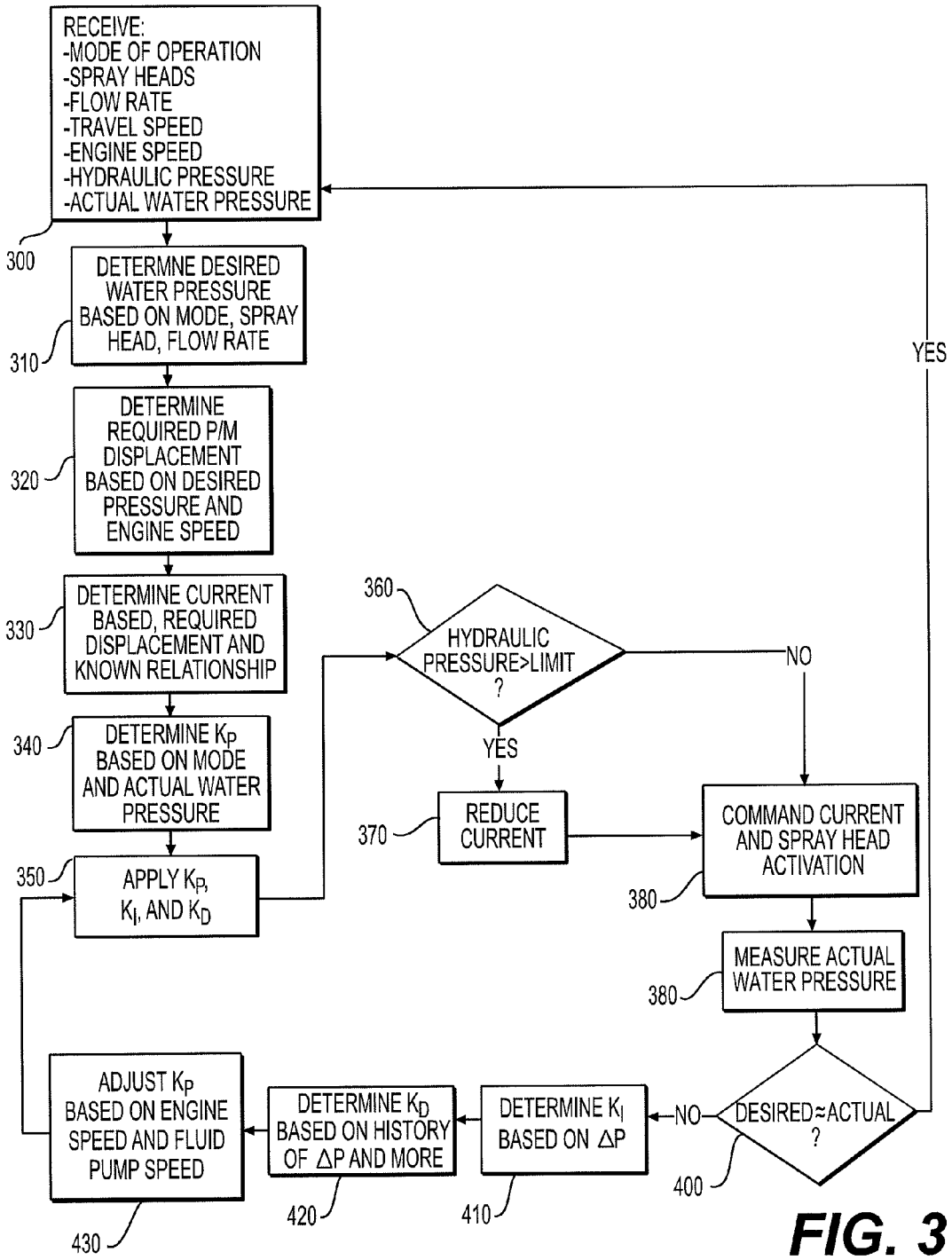
FIG. 3 is a flowchart depicting an exemplary disclosed method that may be performed by the control system of FIG. 2.

Controller 46 may be configured to initiate, monitor, adjust, and terminate specific fluid spray events based on the input received from the operator of machine 10 via interface devices 40 and based on the signals generated by sensors 44. FIG. 3 illustrates an exemplary disclosed method performed by controller 46 during regulation of fluid delivery system 18. FIG. 3 will be discussed in more detail below to further illustrate the disclosed concepts.

INDUSTRIAL APPLICABILITY

The disclosed fluid delivery system may be applicable to any mobile fluid-spraying machine where enhanced control over spray events is desired. The disclosed fluid delivery system may enhance spray events by accounting for factors critically affecting the spray parameters, as well as incorporating both feedforward and feedback control elements. Operation of fluid delivery system 18 will now be described in detail with respect to FIG. 3.

FIG. 3 illustrates an exemplary process of delivering fluid consistent with this disclosure. As shown in the flowchart of FIG. 3, the first step in the process may include receiving operator and sensory input (Step 300). This input may include, among other things, a desired mode of operation (e.g., a selection of one or more of the predefined modes of operation) and/or information relating to an ala carte selection of spray parameters, such as the designation of particular spray heads 16 that should be utilized, desired flow rates of fluid through each of the spray heads 16, etc. This input may also include, the travel speed of machine 10 received via travel speed sensor 44D, the speed of power source 20 received vie engine speed sensor 44C, the hydraulic pressure of power converter 22 received via pressure sensor 44B, and the actual pressure of fluid circuit 24 received via fluid pressure sensor 44A.

Controller 46, based on the information received during completion of step 300, may determine a desired pressure of the fluid to be discharged by fluid pump 34 and sprayed by mobile machine 10 onto the ground surface of worksite 12 (Step 310). This pressure, if not directly provided by the operator via interface device 40B, may be determined based on the mode selection made by the operator, the selected configuration of active spray heads 16, and the flow rate of fluid that should be discharged by fluid pump 34 (Step 310). The desired fluid pressure may be calculated using one or more equations stored in memory, and/or may be determined by referencing the configuration of active spray heads 16 and the desired flow rate with one or more lookup tables stored in memory. Controller 46 may then determine a required displacement of hydraulic pump 28 and/or hydraulic motor 30 that should result in the desired pressure within fluid circuit 24 for a given speed of power source 20 (Step 320). As with step 310, determination of the required displacement of pump 28 and/or motor 30 may be made using one or more equations stored in memory and/or by using one or more lookup tables stored in memory.

Controller 46, in the disclosed embodiment, is a PID (Proportional Integral Derivative) type of controller, that utilizes different gain parameters to adjust the way in which the displacement of pump 28 and/or motor 30 is determined and/or varied. In general, a PID controller includes three different gain parameters, including a $K_P$ parameter, a $K_I$ parameter, and a $K_D$ parameter. The $K_P$ parameter in the disclosed embodiment consists of two components, including a feedback component $K_{P1}$ and a feedforward component $K_{P2}$, wherein $K_P$ is equal to $K_{P1}*K_{P2}$. The $K_{P1}$ component, in the disclosed application, generally corresponds with an amount of change that should be implemented based on an amount of error measured between desired and actual pressure values calculated during a previous iteration of the control cycle. Controller 46 may store different sets of values for the $K_{P1}$ component, each set of values corresponding to the particular mode selected by the operator and each value within a set corresponding to different error values. The $K_{P2}$ component, in the disclosed application, is generally calculated based on a magnitude of the desired pressure, the mode selection made by the operator, engine speed, and/or a speed of fluid pump 34.

The $K_I$ parameter generally corresponds with an amount of change that should be implemented based on an accumulation of pressure error over time. In other words, the $K_I$ parameter may function as a control element that affect an integral action, whose purpose is to drive steady-state error (i.e., the difference between desired and actual pressures) to zero. Like the $K_P$ parameter, controller 46 may also store different sets of values for the $K_I$ parameter, each set of values corresponding to the particular mode selected by the operator and each value within a set corresponding to different ranges of error values. The $K_D$ parameter may be affect a derivative action, whose purpose is to stabilize the system and reduce overshoot in transient response. The $K_D$ parameter may be calculated and/or pulled from a lookup table during each iteration of the process depicted in FIG. 3, based on an accumulation and/or trend of error over multiple iterations, as will be described in more detail below.

After determining the required displacement of power converter 22 (i.e., of hydraulic pump 28 and/or hydraulic motor 30), controller 46 may determine a current that must be supplied to the appropriate displacement adjustment device that results in the required displacement based on a known relationship between current and displacement (Step 330). Controller 46 may then determine the $K_P$ parameter corresponding to the mode selection made by the operator of mobile machine 10 and based on the actual pressure of fluid circuit 24 (Step 340).

Controller 46 may then be configured to apply the $K_P$ parameter determined during the current iteration of the process depicted in FIG. 3, along with the $K_I$ and $K_D$ parameters determined during previous iterations of the process (as will be explained below) (Step 350). The application of the $K_P$, $K_I$ and $K_D$ parameters may increase or decrease the current such that the resulting pressure of fluid discharged from fluid pump 34 more closely matches the desired pressure. Controller 46 may apply these gain parameters according to the following equation:

$$\text{Current}[n]=K_P[\Delta P[n]+K_I\Sigma_{-\infty}^{n}AP[i]+K_D(\Delta P[n]-\Delta P[n-1])$$

In some situations, however, it may be possible for the current determined in step 330 to cause too great an increase in hydraulic pressure within power converter 22. This increase in hydraulic pressure may result in a corresponding increase in torque output of hydraulic motor 30. In this situation, it may be possible for the torque output of hydraulic motor 30 to cause fluid pump 34 to cavitate or otherwise malfunction. Accordingly, controller 46 may be configured to compare the hydraulic pressure within power converter 22 to one or more predefined limits (Step 360). When the hydraulic pressure within power converter 22 exceeds the predefined limit(s), controller 46 may be configured to reduce the current (Step 370). Otherwise the current may remain unchanged at this point in the process.

Depending on the comparison of step 360, control may continue directly or indirectly (i.e., via step 370) to step 380. At step 380, controller 46 may command the full or reduced current be directed to power converter 22, while also directing activation commands to the appropriate spray heads 16. In response to these commands, the displacement of power converter 22 may be adjusted to vary the pressure of fluid discharged from fluid pump 34, and the appropriate spray heads 16 may be rotated, tilted, opened, and/or closed such that the discharged fluid is distributed across the surface of worksite 12 in the manner desired by the operator.

During activation of spray heads 16, controller 46 may utilize the signal from fluid pressure sensor 44A to measure the actual pressure of the fluid being discharged by fluid pump 34 (Step 390). Controller 46 may then compare the actual pressure of the fluid to the desired pressure to determine control accuracy (Step 400). When the actual pressure is within a predefined threshold of the desired pressure, control may return to step 300 for an additional iteration of the process.

However, when the actual pressure is not about equal to the desired pressure (i.e., when the actual pressure is different from the desired pressure by at least the threshold amount), controller 46 may be configured to determine the $K_I$ parameter (Step 410). As described above, a particular set of $K_I$ parameters may be selected based on the particular mode selection made by the operator, and a value for a particular $K_I$ parameter may be selected based directly on the difference between the actual and desired pressures. Controller 46 may then determine the $K_D$ parameter (Step 420). As also described above, a particular value for the $K_D$ parameter may be selected from a lookup table based on an accumulation and/or trend of error over previous iterations of the process (i.e., based on a history of the pressure difference) and based on the operator selected mode of operation.

In some embodiments, the $K_P$ parameter may first be adjusted based on engine speed and fluid pump speed (Step 430), if desired, before applying all of the gain parameters ($K_P$, $K_I$, and $K_D$ parameters) to the current in step 350. That is, it has been determined that engine speed and fluid pump speed during each iteration of the process can affect the accuracy of the process. Accordingly, controller 46 may adjust the gain parameters based on these speeds and one or more relationship tables and/or equations stored in memory.

The disclosed fluid delivery system may consider critical factors affecting water pressure control under different conditions. In addition, the disclosed fluid delivery system may be capable of adjusting the way in which the displacement of power converter 22 is controlled. With this input and capability, the disclosed fluid delivery system may accurately track desired pressure under most operating conditions.

It will be apparent to those skilled in the art that various modifications and variations may be made to the fluid delivery system and method of the present disclosure. It is intended that the specification and examples be considered as exemplary only, with a true scope of the disclosure being indicated by the following claims and their equivalents.

What is claimed is:

1. A method of controlling a mobile fluid delivery machine, comprising:

directing an adjustable power output from the mobile fluid delivery machine through a power converter to a fluid pump, the power converter including a hydraulic pump driven by the mobile fluid delivery machine to pressurize a hydraulic oil, and a hydraulic motor driven by the pressurized hydraulic oil to mechanically rotate the fluid pump;

directing pressurized fluid from the fluid pump to at least one spray head;

receiving from an operator of the mobile fluid delivery machine at least one parameter associated with a desired fluid delivery event;

detecting an actual pressure of fluid discharged from the fluid pump;

determining a desired fluid pressure based on the at least one parameter;

determining a control command for the power converter based on the desired fluid pressure;

determining an engine speed of the mobile fluid delivery machine;

determining a speed of the fluid pump;

determining a feedforward gain parameter based on the engine speed and the speed of the fluid pump;

determining a feedback gain parameter based on a difference between the desired and actual fluid pressures;

adjusting the control command based on the feedforward and feedback gain parameters;

directing the adjusted control command to a variable displacement control mechanism of at least one of the hydraulic pump and motor;

determining a responsiveness gain parameter based on a history of differences between the desired and actual fluid pressures during previous control iterations; and adjusting the control command based further on the responsiveness gain parameter.

2. The method of claim 1, further including:

detecting an engine speed of the mobile fluid delivery machine;

detecting a speed of the fluid pump; and adjusting at least one of the feedback, feedforward, and responsiveness gain parameters based on the engine speed and the speed of the fluid pump.

3. The method of claim 2, further including determining a desired displacement of the at least one of the hydraulic pump and motor that should result in discharge of fluid from the fluid pump at the desired fluid pressure based on the at least one parameter and on the engine speed.

4. The method of claim 3, wherein determining the control command includes determining the control command based on the desired displacement and a known relationship between desired displacement and the control command stored in memory.

5. The method of claim 4, further including:

detecting a pressure of hydraulic oil hydraulic oil discharged from the hydraulic pump;

making a comparison of the pressure of the hydraulic oil with a threshold pressure; and selectively reducing the control command based on the comparison.

6. The method of claim 1, wherein:

the at least one spray head includes a plurality of spray heads; and the at least one parameter is includes at least one of a desired selection of the plurality of spray heads that should be activated and a desired flow rate of fluid through the desired selection of the plurality of spray heads.

* * * * *